United States Patent [19]

Lienert

[11] Patent Number: 4,945,744

[45] Date of Patent: Aug. 7, 1990

[54] METHOD AND APPARATUS FOR FORMING A BARREL COIL SPRING

[75] Inventor: Gerold Lienert, Ontario, Canada

[73] Assignee: Rockwell International Suspension Systems Company, Milton, Canada

[21] Appl. No.: 224,143

[22] Filed: Jul. 26, 1988

[51] Int. Cl.[5] ..... B21F 3/10; B21F 35/02

[52] U.S. Cl. ..... 72/137; 72/139; 72/371

[58] Field of Search ..... 29/173; 72/137, 138, 72/139, 140, 371

[56] References Cited

U.S. PATENT DOCUMENTS

| | | | |
|---|---|---|---|
| 1,676,598 | 7/1928 | Bleuel | 72/138 X |
| 2,335,423 | 11/1943 | Knoop | 72/139 |
| 4,424,695 | 1/1984 | Kirchoff et al. | 72/137 X |
| 4,571,973 | 2/1986 | Morita | 72/137 |
| 4,682,394 | 7/1987 | Wells | 29/173 |
| 4,719,683 | 1/1988 | Ulbing | 29/173 |

FOREIGN PATENT DOCUMENTS

| | | | |
|---|---|---|---|
| 2330208 | 1/1975 | Fed. Rep. of Germany | 29/173 |
| 2515446 | 10/1976 | Fed. Rep. of Germany | 29/139 |

*Primary Examiner*—E. Michael Combs

*Attorney, Agent, or Firm*—Bacon & Thomas

[57] ABSTRACT

A method and apparatus are disclosed for forming a barrel coil spring. The apparatus according to the invention has a rotatable head, and clamping device to attach an end of the coil spring to the rotatable head, a forming die head with at least one forming die which may be inserted between adjacent coils of the spring near the second end such that a forming die bears against an inner surface of a coil, a first rotating device to rotate the head in a first direction about an axis substantially parallel to a longitudinal axis of the coil spring, and a second rotating device to rotate the forming die head in a second direction, opposite to that of the first direction, about an axis substantially parallel to the longitudinal axis of the coil spring. The method according to the invention has the steps of attaching an end of the coil spring to a rotatable head, inserting at least one forming die between adjacent coils so as to bear against an inner surface of a coil, rotating the rotatable head in a first direction about a first axis substantially parallel to a longitudinal axis of the coil spring, and rotating the at least one forming die in a second direction, opposite to that of the first direction, about an axis substantially parallel to the longitudinal axis of the coil spring.

36 Claims, 6 Drawing Sheets

METHOD AND APPARATUS FOR FORMING A BARREL COIL SPRING

BACKGROUND OF THE INVENTION

The present invention relates to a method and an apparatus for forming a coil spring, more particularly a barrel coil spring wherein each end has consecutive coils with decreasing coil diameters.

Methods and apparatus for hot forming coil springs are well known in the art. Typically, such apparatus comprises a rotatable mandrel about which is wound a heated steel rod. Means are provided to clamp one end of the steel rod onto the mandrel and, as the mandrel is rotated, guide means serve to guide the rod as the mandrel traverses along its longitudinal axis to form the coil spring. Once formed, the mandrel may be withdrawn and the coil spring removed from the apparatus.

Such devices have proven very efficient for the manufacture of coil springs having substantially uniform coil diameters. These devices may also be utilized to form coil springs having one barrel end wherein the consecutive coils adjacent this end have decreasing coil diameters. To accomplish this, the rotating mandrel may be formed with a reduced diameter end portion so as to form the coils having decreasing diameters near the end of the coil spring. However, since the length of the mandrel is greater than that of the coil spring and since the mandrel must be withdrawn longitudinally from within the coil spring after the completion of the forming process, it is not possible to form a barrel shaped coil spring, wherein both ends have coils with decreasing diameters, utilizing this apparatus. Thus, it is necessary to use a second forming device to form the second barrel end on the coil spring.

Typical of such devices are those shown in U.S. Pat. Nos. 4,424,695 and 4,571,973. In these arrangements, a shaping member or winding jig is inserted into the coil spring near the second end which is to be reshaped from that having a generally uniform coil diameter to one having consecutively decreasing diameters, and the end of the spring is attached to a rotatable head or spindle. The spring is clamped to the device and the rotatable head or spindle is rotated so as to form the second barrel end. Subsequently the shaping member or winding jig is withdrawn and the spring is unclamped and removed from the device.

While these devices have been generally successful, the apparatus involved has proven to be extremely complex resulting in relatively high manufacturing costs and inherently decreasing the reliability of the appratus. The complexity of the device is increased due to the necessity of having the shaping member inserted into the coil undergo both radial and longitudinal motion to be properly positioned within the coil spring, or to provide the rotary spindle with both rotational and laterally transverse movement capabilities. The number of coil turns that may be reduced in diameter is somewhat limited due to the positioning of the shaping member or winding jig and also since only the roll in head or the rotary spindle can provide the requisite rotation to the end of the coil spring.

SUMMARY OF THE INVENTION

The present invention provides a method and apparatus for forming a barrel coil spring, more paticularly the formation of a second barrel end on a pre-formed spring. The spring may be formed having a first barrel end and a second end with generally uniform coil diameters by the standard coil spring forming mandrel apparatus. The apparatus according to the invention may also be utilized to form barrel end on both ends of the coil spring.

The apparatus according to the invention comprises a rotatable head, clamping means to attach an end of the coil spring to the rotatable head, a forming die head with at least one forming die mounted thereon which may be inserted between adjacent coils of the spring near the second end such that a forming die bears against an inner surface of a coil, first rotating means to rotate the head in a first direction about an axis substantially parallel to a longitudinal axis of the coil spring, and a second rotating means to rotate the forming die head in a second direction, opposite to that of the first direction, about an axis substantially parallel to the longitudinal axis of the coil spring.

The method according to the invention comprises the steps of attaching an end of the coil spring to a rotatable head, inserting at least one forming die between adjacent coils so as to bear against an inner surface of a coil, rotating the rotatable head in a first direction about a first axis substantially parallel to a longitudinal axis of the coil spring, and rotating the at least one forming die in a second direction, opposite to that of the first direction, about an axis substantially parallel to the longitudinal axis of the coil spring.

By utilizing one or more forming dies formed in halves, they can be inserted into the coil spring in a direction substantially perpendicular to the axis of the coil spring without the need for any subsequent longitudinal motion. This eliminates the necessity of apparatus for providing such a complex motion to the forming die required by the prior art devices.

Also, the rotation of the rotatable head in one direction while rotating the forming dies in the opposite direction eliminates the need to provide for additional complex motion of the rotatable head required by the prior art devices. The present invention also eliminates the necesity of providing rotatable support rolls to locate the coil spring with respect to the rotatable head and the forming dies of the prior art devices. The apparatus according to the invention also enables the number of coils having reduced diameters to be varied merely by increasing or decreasing the number of forming dies.

DETAILED DESCRIPTION OF THE PREFERRED EMBODIMENTS

Figure 1:
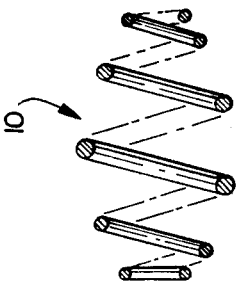
FIG. 1 is a longitudinal cross-sectional view of a barrel shaped coil spring formed according to the method and apparatus of the invention.

FIG. 1 shows a cross sectional view of barrel coil spring 10 wherein the diameters of the coils decrease in directions toward the spring ends. Such springs may be fabricated on the apparatus shown in FIG. 2 which comprises machine base 12 on which are mounted carriages 14 and 16. Each of the carriages 14 and 16 is movable with respect to machine base 12 in directions indicated by arrows 18. Hand wheels 20 and 22 may be interconnected with the carriages 14 and 16, respectively, by known means such that their rotation will cause the carriages to move along their indicated paths.

Rotatable head 24 is mounted on carriage 14 and may be driven by motor 26 through gears 28 and 30. Although a motor and gear drive system is shown, it is to be understood that other means may be provided to rotate rotatable head 24 about its longitudinal axis 32 without exceeding the scope of this invention.

A forming die head, indicated generally at 34 is rotatably attached to carriage 16 such that it may rotate about axis 36 which is substantially parallel to axis 32. Again, any known means may be utilized to rotate the forming die head 34 about this axis, the precise means forming no part of the instant invention.

Forming die head 34 comprises rotatable base member 38 with jaw members 40 and 42 slidably attached thereto. Each of the jaw members is attached to rotatable base member 38 so as to move with respect thereto in directions substantially perpendicular to rotational axis 36. Known feed means are provided between rotatable base 38 and the jaw members 40 and 42 so as to move them toward or away from axis 36, the precise means forming no part of the instant invention. Suffice to say that tool feed means are well known in the art and any such means may be utilized to move the jaw members 40 and 42.

Figure 2:
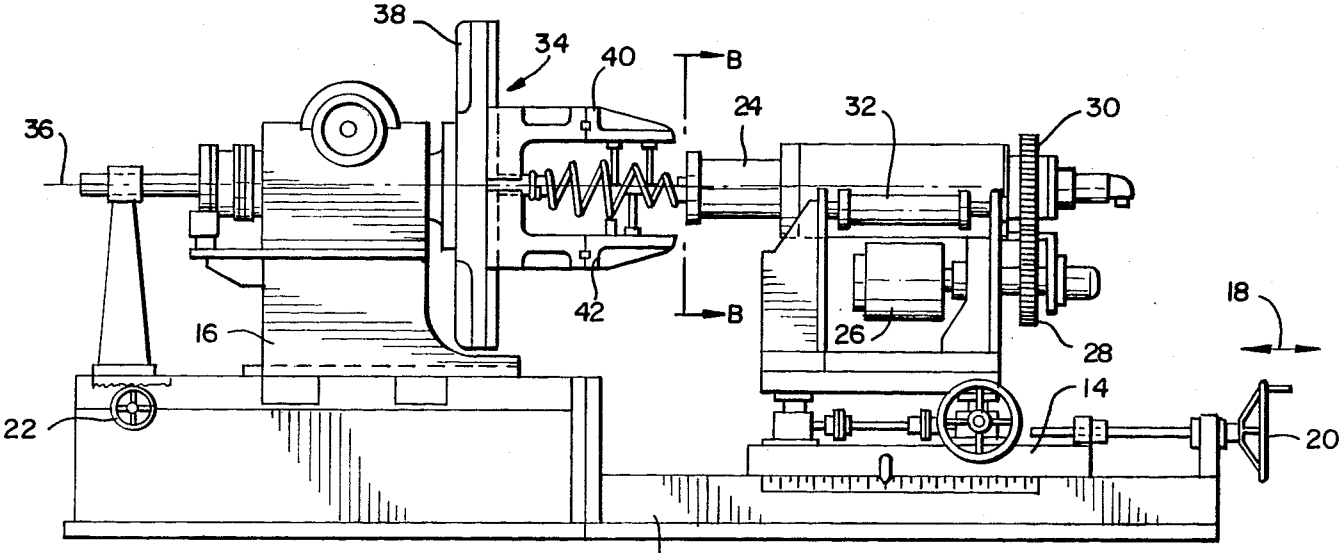
FIG. 2 is a side view of a first embodiment of the apparatus according to the invention.
Figure 3:
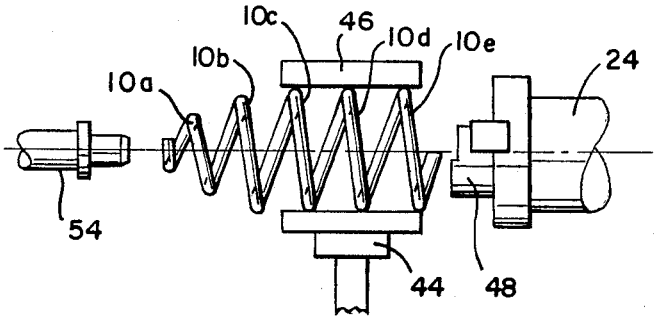
FIGS. 3–7 are schematic diagrams showing the steps in forming the barrel coil spring according to the invention.
Figure 4:
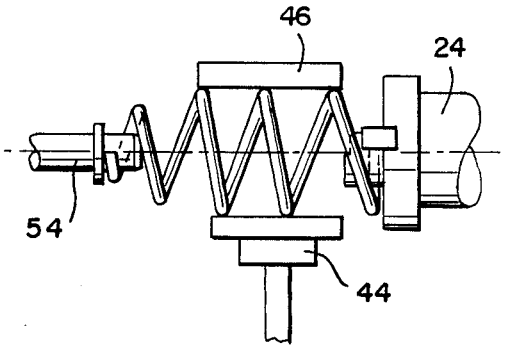

The sequence of operations of the apparatus is illustrated in FIGS. 3–7. The coil spring 10, as shown in FIG. 3, may be initially formed with a first end having a barrel configuration denoted by consecutive coils 10*a* and 10*b* which have decreasing diameters in a direction toward the first end of the spring. Coils 10*c*–10*e* are formed so as to have a generally uniform coil diameter. The spring may be formed in this configuration by known coil spring forming machines and is transferred to the apparatus shown in FIG. 1 by gripping jaws 44 and 46. The transfer of the coil spring from the initial forming apparatus to the apparatus shown in FIG. 2 is such that the temperature of the coil spring rod is elevated so as to permit formation of the second barrel end. Gripping jaws 44 and 46 may be manipulated manually or may form part of an automatic transfer means shown in FIGS. 13 and 14 which will be described in more detail hereinafter.

Figure 10:
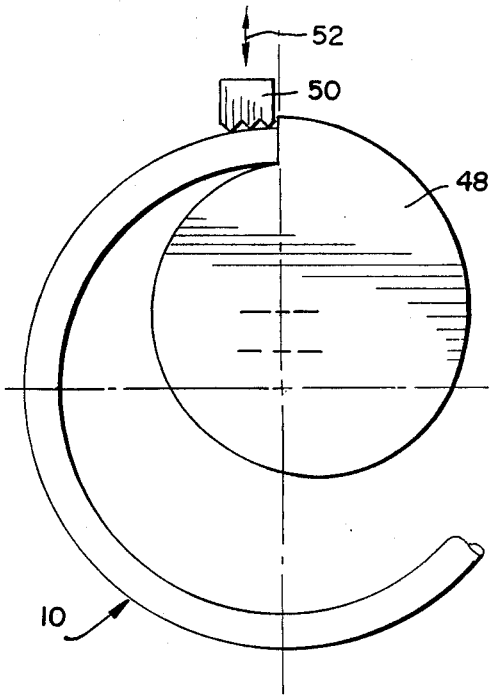
FIG. 10 is a partial view along line B—B in FIG. 2 showing the rotatable head in its initial position.
Figure 11:
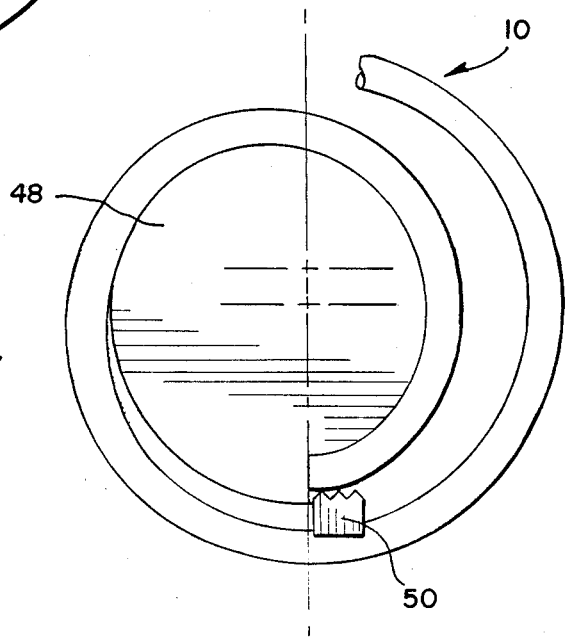
FIG. 11 is a view similar to FIG. 10 showing the rotatable head after it has been rotated through approximately 180°.

Rotatable head 24 has shaping die 48 extending from one end and a clamping means associated therewith so as to clamp the second end of the spring onto the shaping die. As best seen in FIGS. 10 and 11, the clamping means may comprise a clamping jaw 50 attached to the rotatable head 24 so as to be movable in directions indicated by arrows 52 in FIG. 10. The second end of coil spring 10 ss attached to shaping die 48 by clamping jaw 50 as illustrated in FIG. 10. The first end of the coil spring is supported via shaft 54, associated with forming die head 34. Gripping jaws 44 and 46 are removed from the spring and withdrawn.

Figure 5:
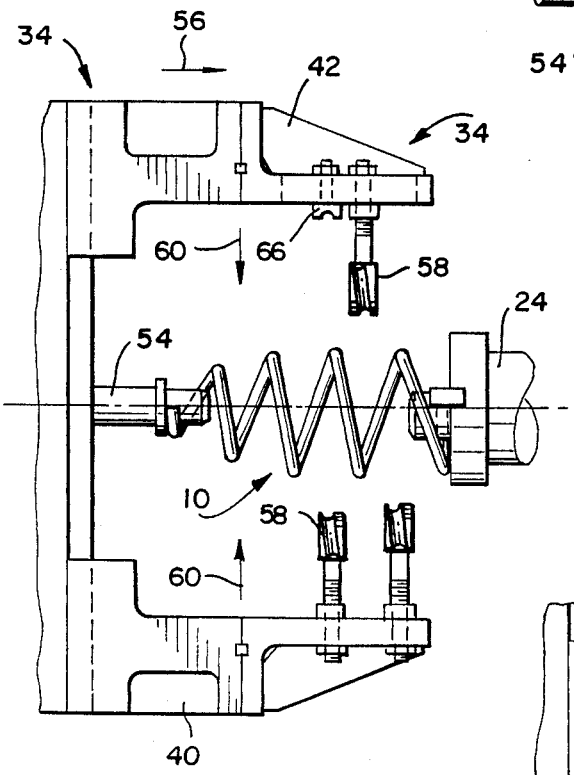
Figure 9:
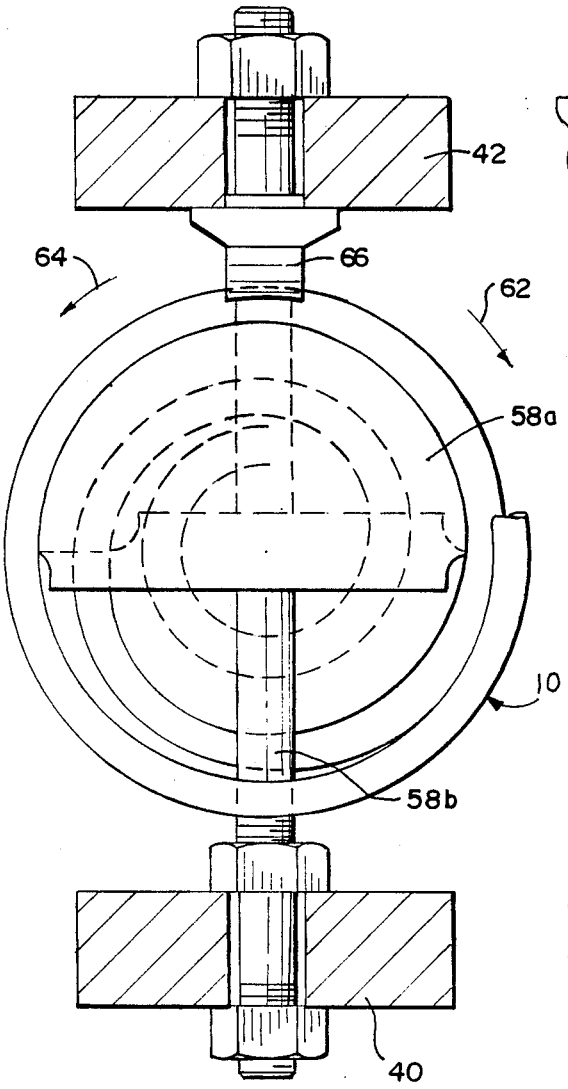
FIG. 9 is a cross-sectional view showing the forming dies taken along line A—A in FIG. 8.
Figure 8:
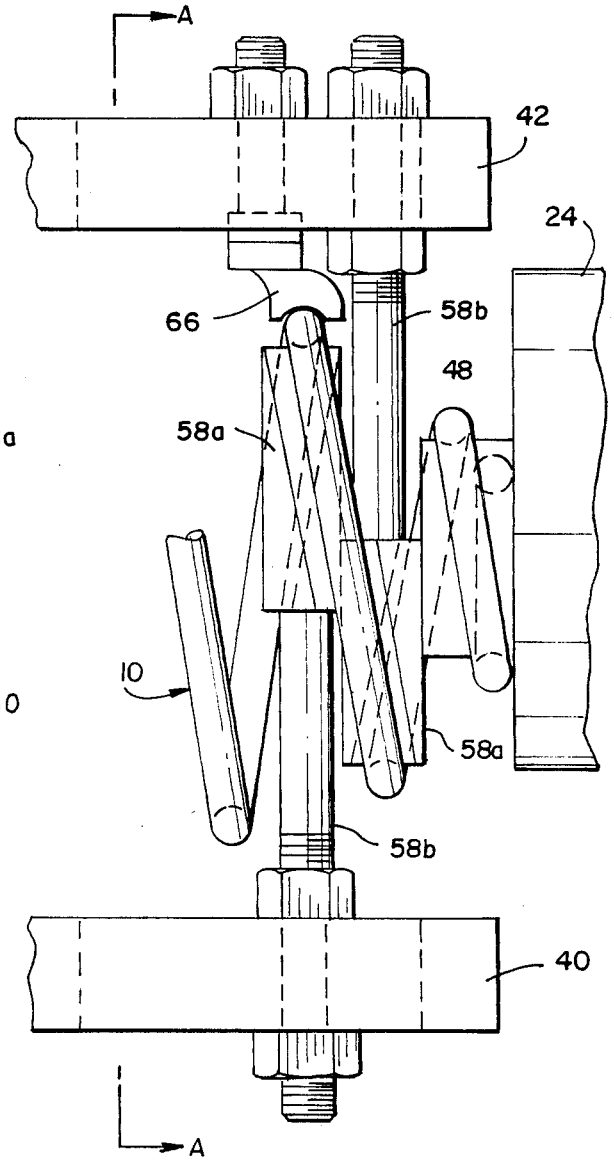
FIG. 8 is a partial side view showing the forming dies according to the invention.

Forming die head 34 is then advanced in the direction of arrow 56 from its retracted position until the position shown in FIG. 5 is reached. Jaw members 40 and 42 each have at least one forming die 58 mounted thereon which extends toward coil spring 10. The forming dies 58, as shown in FIGS. 8 and 9, comprise a generally semi-cylindrical portion 58*a* mounted to the jaw members via mounting rods 58*b*. The curved outer surfaces of the forming dies 58*a* may define a groove therein to accommodate coils to spring 10.

Jaw member 40 and 42 are moved in the direction of arrows 60 to insert the forming dies 58 between adjacent coils until they each bear against an inner surface of the coil spring 10. At this point, rotatable head 24 is rotated in a first direction, indicated by arrow 62 in FIGS. 6 and 9. After rotatable head 24 is rotated a predetermined amount, usually on the order of 180° as indicated in FIG. 11, forming die head 34 is rotated in the opposite direction indicated by arrow 64 in FIGS. 6 and 9. Rotation of forming die head 34 causes forming dies 58 as well as die clamp 66, attached to jaw member 42 and bearing against an outer surface of the coil spring, to rotate therewith a predetermined amount, usually not exceeding 360°. Although only one forming die 58 is shown attached to each of the jaw members 40 and 42 in FIGS. 5, 6 and 8, it is to be understood that more than one such forming die can be associated with the jaw members as illustrated in FIG. 2.

Figure 6:
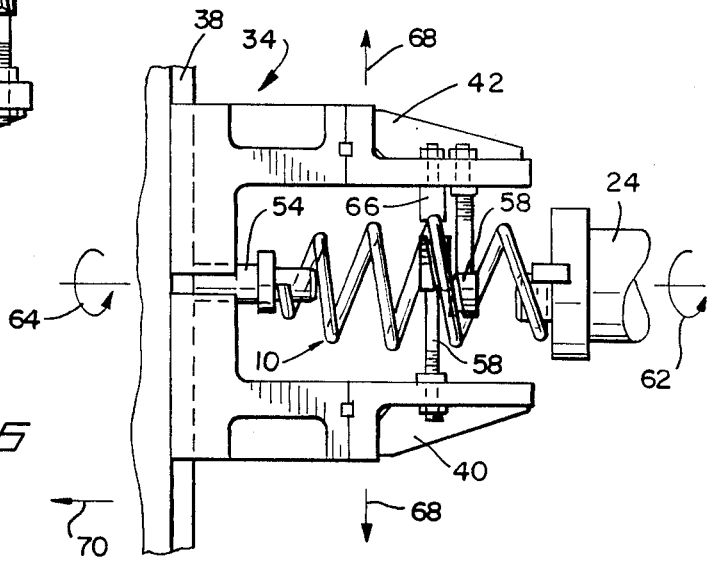

Upon completion of the rotation of the forming die head 34, the jaw members 40 and 42 are withdrawn in the direction of arrows 68 and the forming die head 34 is traversed to its retracted position in the direction of arrow 70, illustrated in FIG. 6.

At this point, gripping jaws 72 and 74 grip coil spring 10, and rotatable head 24 and shaft 54 are withdrawn in the direction of arrows 76 and 78, respectively. The gripping jaws then transfer the completely formed coil spring 10 to a heat treating or cooling operation.

Figure 12:
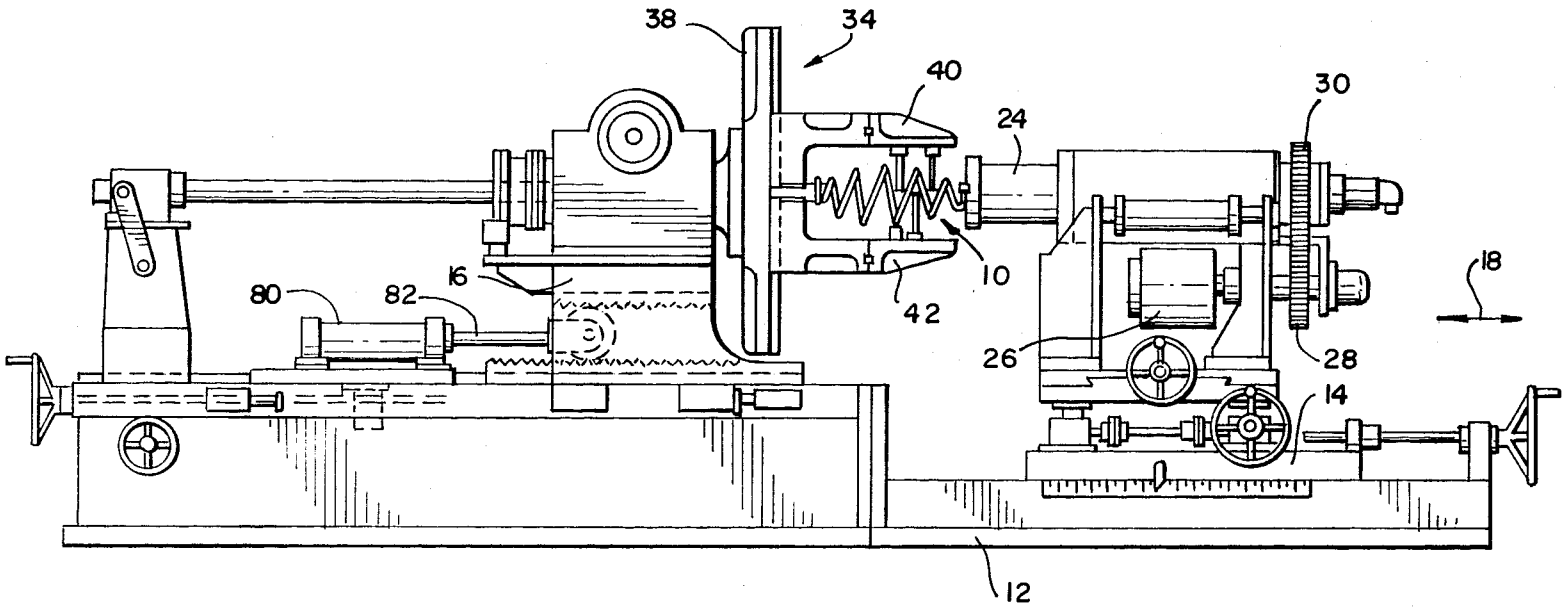
FIG. 12 is a side view of a second embodiment of the apparatus according to the invention.

The apparatus may be slightly modified, as shown in FIG. 12 to incorporate an automatic feed sysem for carriage 16. The rotatable head 24, the rotatable base member 38, the jaw members 40 and 42, as well as the forming dies 58 function exactly the same as in the previously described embodiment and have been indicated by the same numbers in FIG. 12. The traversing of carriage 16 in the direction of arrows 18 is accomplished by cylinder 80 mounted on machine base 12 and having an extendable and retractable piston rod 82 attached to carriage 16. Cylinder 80 may be actuated by hydraulic or pneumatic fluid an may form part of an automatic control system which automatically positions carriage 16 and actuates the motions of jaw members 40 and 42. Such a system may also encompass the clamping and unclamping of clamp 50 so as to clamp or release the end of spring 10 as well as the rotation and longitudinal positioning of rotatable head 24.

Figure 13:
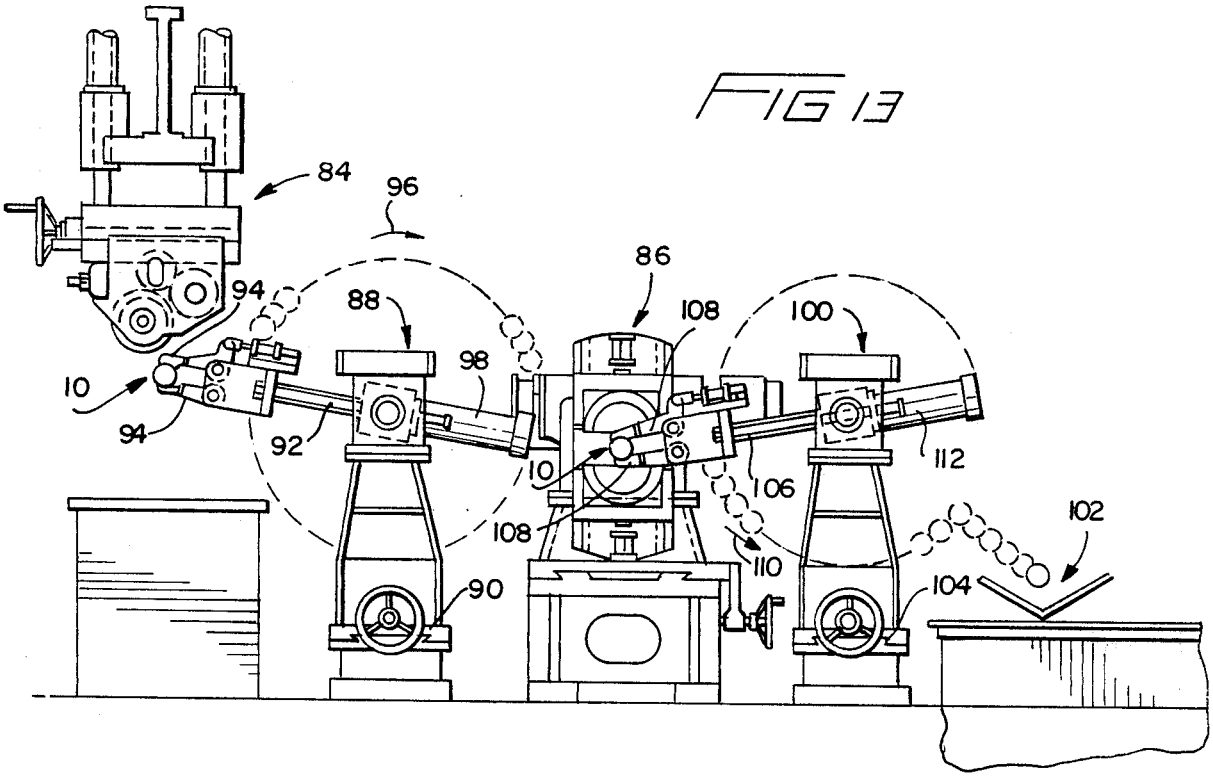
FIG. 13 is a front view of a production line assembly incorporating the apparatus of FIG. 12.
Figure 14:
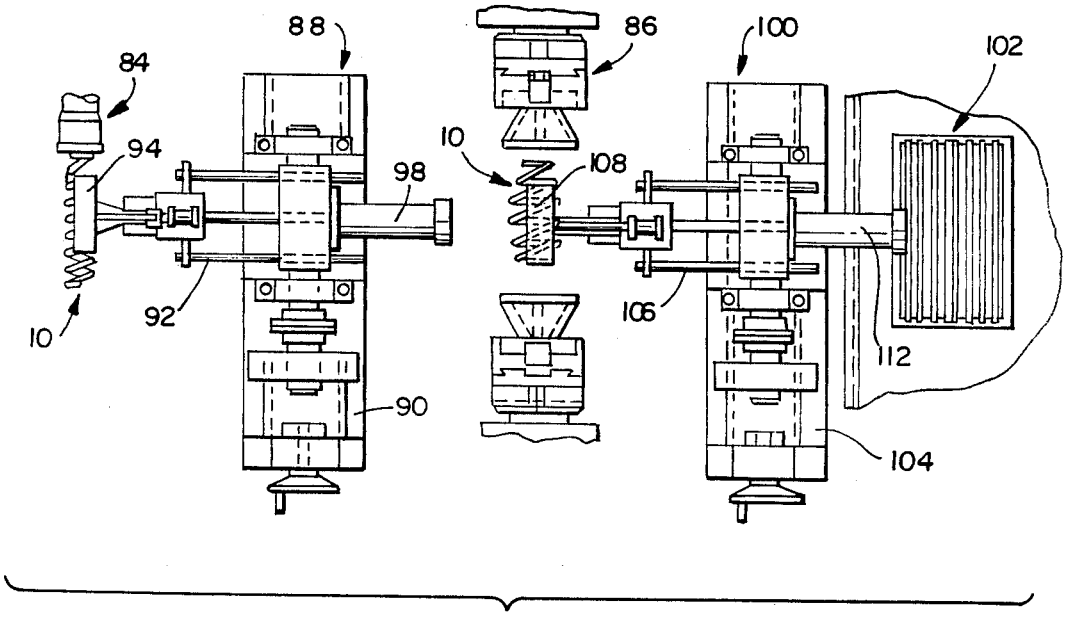
FIG. 14 is a partial, top view of the production line assembly shown in FIG. 13.

The fully automated apparatus shown in FIG. 12 may be part of the automated assembly line shown in FIGS. 13 and 14. It is envisioned that such an automated assembly line would comprise a known coil spring mandrel apparatus 84 which would produce the coil spring having one barrel end while the other end has generally uniform coil diameters as indicated in FIG. 3. The structural details and the operation of such machines are well known in the are and no further description is believed to be necessary.

Once the spring has been formed in this configuration, it is transferred to the barrel forming machine shown in FIG. 12, which is indicated generally at 86 in FIGS. 13 and 14 by first transfer means 88. Transfer means 88 may comprise a base portion 90 having a transfer arm 92 rotatably attached thereto so as to rotate about an axis substantially parallel to that of the coil spring 10. Arm 92 has gripping jaws 94 attached thereto such that spring 10 may be gripped between them. Gripping jaws 94 may be actuated by known means so as to selectively grip and release coil spring 10. First transfer means 88 also has means thereon to rotate arm 92 about its axis in the direction of arrow 96 so as to transfer the coil spring 10 from the winding apparatus 84 to the barrel forming apparatus 86. Arm 94 may be extended or retracted via cylinder 98 so as to properly locate the coil spring 10 in the respective apparatus.

Figure 7:
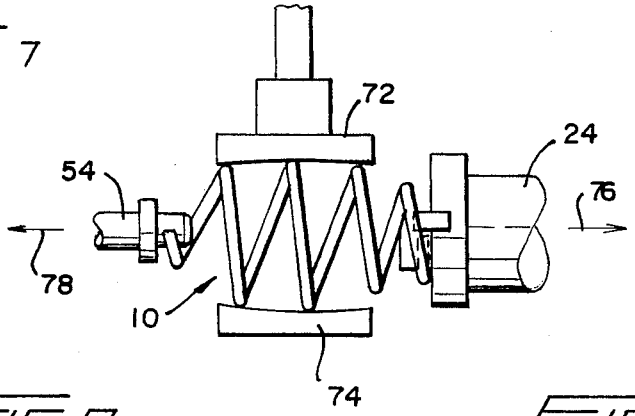

After the coil spring 10 has been clamped onto rotatable head 24 and supported by shaft 54 (see FIG. 4), jaws 94 are opened and the rotatable arm returns to its initial position. Apparatus 86 carries out the previously described functions of forming the barrel shape on the second end of the coil spring as illustrated in FIGS. 5–7.

Upon completion of th cyle and the withdrawal of forming die head 34 to its retracted position, second transger means 100 transfers the formed coil spring from apparatus 86 to a quench dunk tank illustrated at 102. Second transfer device 100 may also comprise a base 104 having an arm 106 rotatably attached thereto so as to rotate about an axis substantially parallel to the rotational axis of arm 92. Rotatable arm 106 has gripping jaws 108 attached thereto and means thereon to selectively grip and release the coil spring 10. After the jaws 108 have gripped coil spring 10, rotatable head 24 and the shaft 54 are retracted (see FIG. 7) and arm 106 is rotated in the direction of arrow 110 to transfer the coil spring to the quench dunk tank 102. Again, arm 106 may be extended and retracted by way of cylinder 112 associated therewith.

The foregoing description is provided for illustrative purposes only and should not be construed as in any way limiting this invention, the scope of which is defined solely by the apended claims.

What is claimed is:

1. A method of forming a coil spring having a reduced coil diameter end portion comprising the steps of:

(a) attaching an end of the coil spring to a first rotatable head;

(b) inserting at least one forming die between adjacent coils so as o bear against an inner surface of a coil;

(c) rotating the first rotatable head in a first direction about a first axis substantially parallel to a longitudinal axis of the coil spring; and, (d) rotating the at least one forming die in a second direction opposite to the first direction about a second axis substantially parallel to a longitudinal axis of the coil spring.

2. The method according to claim 1 comprising the additional step of advancing the at least one forming die in a direction substantially parallel to the longitudinal axis of the coil spring from a retracted position wherein it is withdrawn from the coil spring to a working position adjacent to the coil spring prior to inserting the at least one forming die between adjacent coils of the spring.

3. The method according to claim 1 wherein the first rotatable head is rotated in the first direction an amount not greater than 180°.

4. The method according to claim 1 wherein the at least one forming die is rotated in the second direction an amount not greater than 360°.

5. The method according to claim 1 comprising the additional step of inserting a second forming die between adjacent coils of the coil spring in a direction substantially opposite to that of the at least one forming die before rotating the rotatable head, such that the second forming die bears against an inner surface of a coil.

6. The method according to claim 1 which the at least one forming die is inserted between adjacent coils in a direction substantially perpendicular to the longitudinal axis of the coil spring.

7. The method according to claim 6 comprising the additional step of inserting a second forming die between adjacent coils of the coil spring in a direction substantially opposite to that of the at least one forming die before rotating the rotatable head such that the second forming die bears against an inner surface of a coil.

8. The method according to claim 7 comprising the additional step of advancing the at least one forming die and the second forming die in a direction substantially parallel to the longitudinal axis of the coil spring from a retracted position wherein they are withdrawn from the coil spring to a working position adjacent to the coil spring prior to inserting the at least one forming die and the second forming die between adjacent coils of the spring.

9. The method accordig to claim 8 wherein the first rotatable head is rotated in the first direction an amount not greater than 180°.

10. The method according to claim 9 wherein the at least one forming die is rotated in the second direction an amount not greater than 360°.

11. The method of forming a barrel coil spring having a longitudinal axis comprising the steps of:

(a) forming the coil spring with a first end portion having consecutively decreasing coil diameters and a second end portion having generally uniform coil diameters;

(b) attaching the second end portion to a rotatable head;

(c) inserting at least one forming die between adjacent coils near the second end such that the at least one forming die bears against an inner surface of a coil;

(d) rotating the rotatable head in a first direction about a first axis substantially parallel to the longitudinal axis of the coil spring; and, (e) rotating the at least one forming die in a second direction opposite to the first direction about an axis substantially parallel to the longitudinal axis of the coil spring such that the second end portion has consecutively decreasing coil diameters.

12. The method according to claim 11 further comprising the additional step of moving the at least one forming die in a direction substantially parallel to the longitudial axis of the coil spring from a retracted position wherein it is withdrawn from the coil spring to a working poistion adjacent the coil prior to inserting the at least one forming die between adjacent coils of the spring.

13. The method according to claim 11 wherein the rotatable head is rotated in the first direction not greater than 180°.

14. The method according to claim 11 wherein the at least one forming die is rotated in the second direction not greater than 360°.

15. The method according to claim 11 comprising the additional step of inserting a second forming die between adjacent coils of the spring in a direction substantially opposite to the at least one forming die before rotating the rotatable head such that the second forming die bears against an inner surface of a coil.

16. The method according to claim 11 wherein the step of inserting the at least one forming die comprises inserting the at least one die between adjacent coils in a direction substantially perpendicular to the longtudinal axis of the coil spring.

17. The method according to claim 16 comprising the additional step of inserting a second forming die between adjacent coils of the spring in a direction substantially opposite to the at least one forming die befoe rotating the rotatable head such that the second forming die bears against an inner surface of a coil.

18. The method according to claim 17 further comprising the additional step of moving the at least one forming die and the second forming die in a direction substantially parallel to the longitudinal axis of the coil spring from a retracted position wherein they are withdrawn from the coil spring to a working position adjacent to the coil spring prior to inserting the at least one forming die and the second forming die between adjacent coils of the spring.

19. The method according to claim 18 wherein the rotatable head is rotated in the first direction not greater than 180°.

20. The method according to claim 19 wherein the at least one forming die is rotated in the second direction not greater than 360°.

21. Apparatus for forming a barrel coil spring from a coil spring having a first end and a second end having generally uniform coil diameters, and a longitudinal axis comprising:

(a) a rotatable head;
(b) clamping means to attach the second end of the coil spring to the rotatable head;
(c) a forming die head having at least one forming die mounted thereon;
(d) feed means associated with the forming die head to feed the at least one forming die between generally uniform diameter coils near the second end such that the forming die bears against an inner surface of a coil;
(e) first rotating means to rotate the rotatable head in a first direction about an axis substantially parallel to the longitudinal axis of the coil spring; and,
(f) second rotating means to rotate the forming die head in a second direction, opposite to the first direction, about an axis substantially parallel to the longitudinal axis of the coil spring.

22. The barrel coil spring forming apparatus according to claim 21 further comprising means to translate the forming die head in a direction substantially parallel to the longitudinal axis of the coil spring between an operative position wherein the at least one forming die is adjacent to the coil spring and a retracted position wherein it is withdrawn therefrom.

23. The barrel coil spring forming apparatus according to claim 21 wherein the first rotating means rotates the rotatable head in the first direction not greater than 180°.

24. The barrel coil spring forming apparatus according to claim 21 wherein the second rotating means rotates the forming die head in the second direction not greater than 360°.

25. The barrel coil spring forming apparatus according to claim 21 wherein the forming die head comprises:

(a) a rotatable base member;
(b) first and second jaw members slidably attached to the rotatable base member;
(c) at least one first forming die attached to the first jaw member;
(d) at least one second forming die attached to the second jaw member; and,
(e) means connecting the first and second jaw members to the feed means such that the feed means moves the jaw members toward or away from each other in a direction substantially perpendicular to the longitudinal axis of the coil spring.

26. The barrel coil spring forming apparatus according to claim 25 further comprising meand to translate the forming die head in a direction substantially parallel to the longitudinal axis of the coil spring between an operative position wherein the at least one first and second forming dies are adjacent to the coil spring and a retracted position wherein they are withdrawn therefrom.

27. The barrel coil spring forming apparatus according to claim 26 wherein the first rotating means rotates the rotatable head in the first direction not greater than 180°.

28. The barrel coil spring forming apparatus according to claim 27 wherein the second rotating means rotates the forming die head in the second direction not greater than 360°.

29. Apparatus for forming a barrel coil spring comprising:

(a) first coil forming means to form a coil spring with a longitudinal axis having a first end having consecutively decreasing coil diameters and a second end having generally uniform coil diameters;
(b) second coil forming means comprising:
(i) a rotatable head;
(ii) clamping means to attach the second end of the coil spring to the rotatable head;
(iii) a forming die head having at least one forming die mounted thereon;
(iv) feed means associated with the forming die head to feed the at least one forming die between adjacent generally uniform diameter coils near the second end such that the forming die bears against an inner surface of a coil;
(v) first rotating means to rotate the rotatable head in a first direction about an axis substantially parallel to the longitudinal axis of the coil spring; and,
(vi) second rotating means to rotate the forming die head in a second direction, opposite to the first direction, about an axis substantially parallel to the longitudinal axis of the coil spring; and,
(c) first transfer means to transfer the spring from the first coil forming means to the second coil forming means.

30. The apparatus according to claim 29 wherein the first transfer means comprises:

(a) a first base portion;
(b) a first transfer arm rotatably attached to the first base portion so as to rotate about an axis substantially parallel to the longitudinal axis of the coil spring;
(c) first means to rotate the first transfer arm about its rotational axis;
(d) first gripping jaws attached to the transfer arm; and,
(e) first actuating means to actuate the first gripping jaws so as to selectively grip or release the coil spring.

31. The apparatus according to claim 30 further comprising:
(a) quench dunk means adapted to receive a spring; and,
(b) second transfer means to transfer the spring from the second coil forming means to quench dunk means.

32. The apparatus according to claim 31 wherein the second transfer means comprises:
(a) a second base portion;
(b) a second transfer arm rotatably attached to the second base portion so as to rotate about an axis substantially parallel to the longitudinal axis of the coil spring;
(c) second means to rotate the second transfer arm about its rotational axis;
(d) second gripping jaws attached to the second transfer arm; and,
(e) second actuating means to actuate the second gripping jaws so as to selectively grip or release the coil spring.

33. The barrel coil spring forming apparatus according to claim 32 further comprising means to translate the forming the head in a direction substantially parallel to the longitudinal axis of the coil spring between an operative position wherein the at least one forming die is adjacent to the coil spring and a retracted position wherein it is withdrawn therefrom.

34. The barrel coil spring forming apparatus according to claim 33 wherein the first rotating means rotates the rotatable head in the first direction not greater than 180°.

35. The barrel coil spring forming apparatus accordin to claim 34 wherein the second rotating means rotates the forming die head in the second direction not greater than 360°.

36. The barrel coil spring forming apparatus according to claim 35 wherein the forming die head comprises:
(a) a rotatable base member;
(b) first and second jaw members slidably attached to the rotatable base member;
(c) at least one first forming die attached to the first jaw member;
(d) at least one second forming die attached to the second jaw member; and,
(e) means connecting the first and second jaw members to the feed means such that the feed means moves the jaw members toward or away from each other in a direction substantially perpendicular to the longitudinal axis of the coil spring.

* * * * *